US009011123B2

(12) United States Patent
McIntyre

(10) Patent No.: US 9,011,123 B2
(45) Date of Patent: Apr. 21, 2015

(54) SWINGING ABUTMENT ROTARY PUMP

(71) Applicant: John McIntyre, Traverse City, MI (US)

(72) Inventor: John McIntyre, Traverse City, MI (US)

( * ) Notice: Subject to any disclaimer, the term of this patent is extended or adjusted under 35 U.S.C. 154(b) by 0 days.

(21) Appl. No.: 14/022,486

(22) Filed: Sep. 10, 2013

(65) Prior Publication Data

US 2015/0071807 A1 Mar. 12, 2015

(51) Int. Cl.

| | |
|---|---|
| ***F03C 4/00*** | (2006.01) |
| ***F04C 2/00*** | (2006.01) |
| ***F04C 18/00*** | (2006.01) |
| ***F04C 18/02*** | (2006.01) |
| ***F04C 2/356*** | (2006.01) |
| ***F04C 2/46*** | (2006.01) |
| ***F01C 1/356*** | (2006.01) |
| ***F01C 1/46*** | (2006.01) |
| *F01C 21/18* | (2006.01) |

(52) U.S. Cl.

CPC ..... *F04C 18/02* (2013.01); *F04C 2/3564* (2013.01); *F04C 2/46* (2013.01); *F01C 21/18* (2013.01); *F01C 1/3564* (2013.01); *F01C 1/46* (2013.01)

(58) Field of Classification Search

USPC ..... 418/248–250, 178–179, 152, 15

See application file for complete search history.

(56) References Cited

U.S. PATENT DOCUMENTS

| | | | | |
|---|---|---|---|---|
| 715,933 | A * | 12/1902 | Allen | 418/249 |
| 2,060,209 | A * | 11/1936 | Heckert | 418/182 |
| 2,238,395 | A * | 4/1941 | Nittka | 418/248 |
| 3,759,640 | A * | 9/1973 | Hinckley et al. | 418/249 |
| 7,766,636 | B2 * | 8/2010 | Szepesy | 418/248 |
| 7,798,739 | B2 * | 9/2010 | Bar et al. | 403/354 |
| 2005/0053509 | A1 * | 3/2005 | Liposcak | 418/268 |

FOREIGN PATENT DOCUMENTS

| | | | | |
|---|---|---|---|---|
| CH | 657655 | A5 * | 9/1986 | 418/248 |

* cited by examiner

*Primary Examiner* — Theresa Trieu

(57) ABSTRACT

A rotary pump device includes a stator chamber with a cylindrical inner wall having intake and exhaust ports and a swinging abutment mounted therein, and a rotor eccentrically mounted on an axial drive shaft for rotation within the chamber. The rotor keeps continuous wiping contact with the chamber wall while the swinging abutment maintains contact with the rotor to partition the intake and outlet ports. In a single abutment configuration, a full intake/exhaust cycle occurs every 360° of rotor travel.

2 Claims, 4 Drawing Sheets

SWINGING ABUTMENT ROTARY PUMP

FIELD OF THE INVENTION

The invention is in the field of pumps, and more particularly rotary pumps of the type having an abutment within a stator chamber with inlet and outlet ports.

BACKGROUND OF THE INVENTION AND DESCRIPTION OF RELATED ART

The term "abutment pump" is used herein to refer to a device comprising a movable partition separating the inlet and outlet streams within a stator chamber or housing and a rotor that rotates within the chamber to cause sequential intake, compression, and the exhaust of a fluid medium such as a gas, a liquid, or combination thereof. The term, therefore, comprehends not only devices that cause fluid movement but also devices that compress or pressurize fluids with or without ignition or combustion. Further, the term "abutment pump" embraces a reverse operation in which fluid drives a rotor rather than the rotor driving the fluid, i.e., in reverse operation every pump is effectively a motor.

One example of an abutment configuration is shown in U.S. Pat. No. 2,238,395 to Nittka. The pump in the Nittka patent comprises a rotor working in unison with a flapper requiring numerous components. The device is characterized by the complexity of the many parts required to manipulate the flapper.

Another example of an abutment configuration is shown in U.S. Pat. No. 715,933 to Allen. The engine and pump in the Allen patent comprises dual abutments working in unison with rotary valves with exhaust stream traveling through a port in the rotor expelled through the driveshaft. The device is complicated and requires several parts working in combination with the abutments.

BRIEF SUMMARY OF THE INVENTION

The present invention comprises a pump structure having a stator chamber with a substantially continuous wall with intake and exhaust ports and swinging abutment pocket therein. The pump further comprises a centrically positioned shaft with an eccentrically mounted rotor within the chamber such that as the rotor rotates, the rotor maintains a wiping contact between a segment of the outside diameter of the rotor and the inner wall of the chamber. The swinging abutment affixed in the swinging abutment pocket maintains contact with the outside diameter of the rotor to effect intake, compression, and exhaust functions with each 360° (degrees) of rotor movement.

In an illustrative embodiment, the chamber inner wall is cylindrical and the rotor is comprised of a cylindrical body with a segment having contact with the chamber inner wall so that each 360° of rotation the rotor body is in contact with the inner wall except during the period when the rotor body is in direct contact with the conforming inner wall surface of the swinging abutment.

In the illustrative embodiment, the rotor body urged by centrifugal force has continuous wiping contact with the inner wall and the conforming inner wall surface of the swinging abutment.

In a further illustrative embodiment, the rotor body is provided with a drive slot engaged by a mating tongue of a drive member. In another form, the rotor body includes a tongue structure and the drive member includes a slot feature.

In one illustrative embodiment, the stator is provided with dual swinging abutments and additional intake and exhaust ports to create multiple pumping chambers within a stator.

In accordance with a preferred embodiment hereafter described, the trailing rotor body segment that contacts the inner wall has a wear compensating feature along the radius of the stator. The intake and exhaust ports are spaced-apart from each other and separated by the partition of a swinging abutment. As will be understood from the following specification, the pump of the present invention can be scaled to any desired capacity with pump components being constructed using any material or combination of materials including hard dense plastics such as HDPE, ceramics, cermets, and/or metals.

These and other features and advantages of the invention will become apparent from the detailed description below, in light of the accompanying drawings.

BRIEF DESCRIPTION OF THE DRAWINGS

For purposes of clarity and brevity, like elements and components will bear the same designations and numbering throughout the Figures.

DETAILED DESCRIPTION OF THE INVENTION

Figure 1:
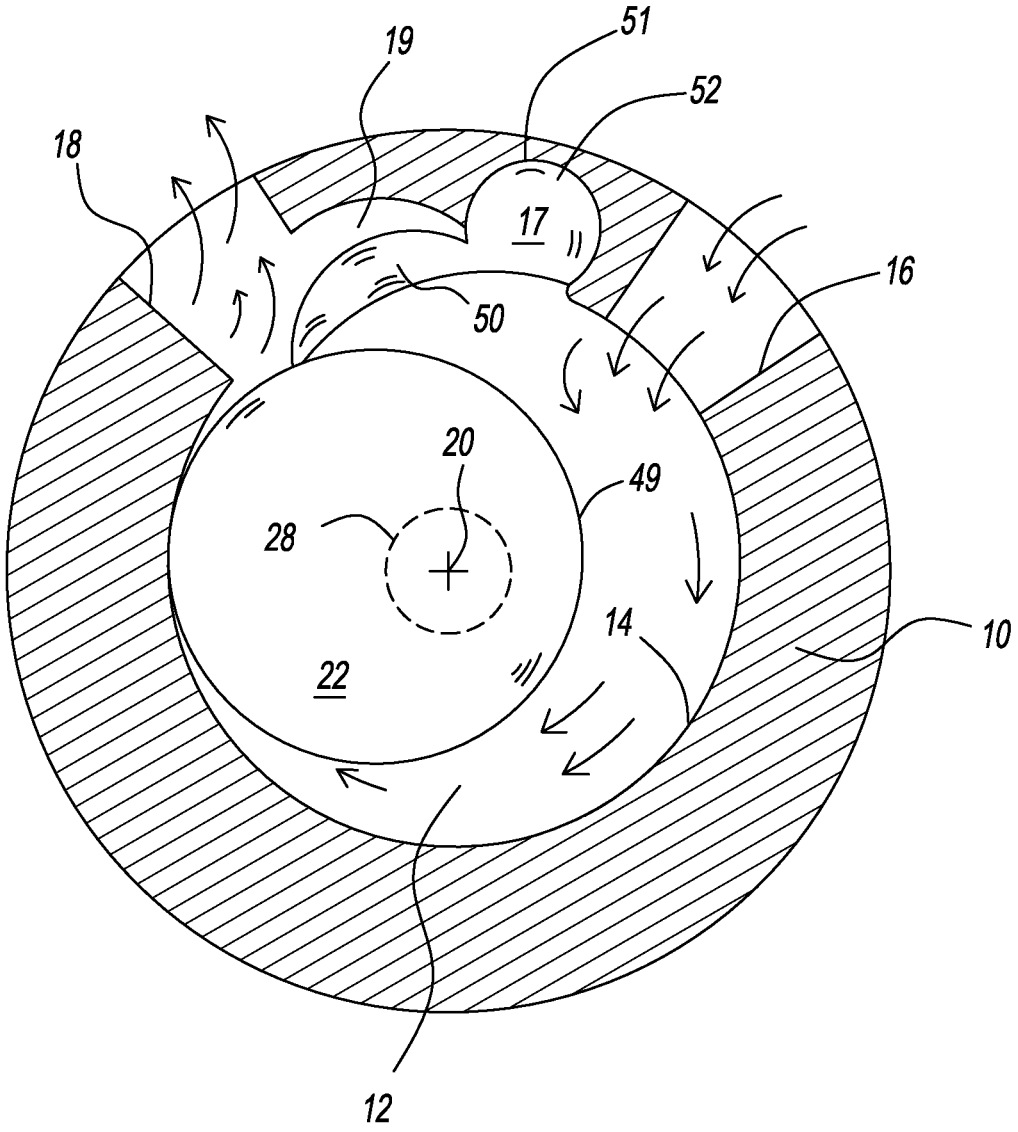
FIG. 1 is a plan view of a pump embodying the invention with the rotor in contact with the swinging abutment that separates the intake port and exhaust port.

Referring to FIGS. 1 and 2A-2D, there is shown a pump 10 comprising a stator 12 defining a cylindrical chamber having an inner wall 14 interrupted only by the spaced-apart intake (inlet) and exhaust (outlet) ports 16 and 18 respectively and the swinging abutment pocket 19 that accommodates the swinging abutment 17. It is understood that a cover plate or other structure (not shown) closes the chamber when all parts described are installed. The chamber is cylindrical as defined by the inner wall, and has a geometric center at 20.

An eccentrically mounted rotor 22 is comprised of a cylindrical body for rotation with an input structure, the axial drive post 28. The rotor body has an outer diameter that is less than the diameter of the circular inner wall 14. With rotation in a clockwise rotation when viewing the pump 10 in FIGS. 2A-2D, a segment of the outside diameter of the rotor body is the contact or wiping surface against the inner wall. During rotation, there is continuous wiping contact with the chamber inner wall. In FIG. 2B, note the swinging abutment 17 does not completely seal the outlet port 18.

Rotor drive comes from driven post or shaft 28, its location is the geometric center of the stator 20. The swinging abutment 17 is located between intake and exhaust ports. The swinging abutment 17 is affixed in the swinging abutment pocket 19 which also allows for the swinging abutment to pivot maintaining edge contact with the rotor. Forces that act upon the swinging abutment to maintain edge contact with the rotor also act upon the pivoting joint 52 of the swinging abutment exerting a sealing action in the pivot joint 51 area of the swinging abutment pocket decreasing leakage into the inlet side of the pump stator chamber.

The swinging abutment 17 affixed in the swinging abutment pocket 19 maintains continuous contact with the outside diameter 49 of the rotor. Various pressures exerted upon the swinging abutment, specifically the abutment flapper 50 provide sealing with the rotor outside diameter effectively creating a partition of inlet and outlet streams to effect intake, compression, and exhaust functions with each 360° of rotor movement. Although other forces assist with the swinging abutment in maintaining sealing contact with the rotor, the primary force applied is the outlet pressure.

Figure 2A:
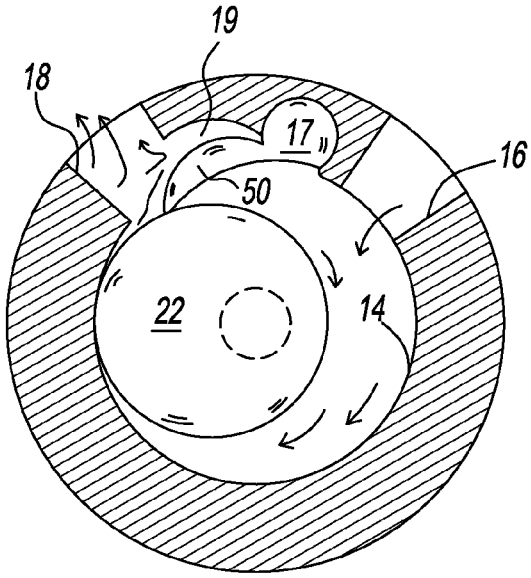
FIGS. 2A-2D make up a schematic, sequential showing of the rotor and swinging abutment position and fluid flow over approximately 360° of rotation.
Figure 2B:
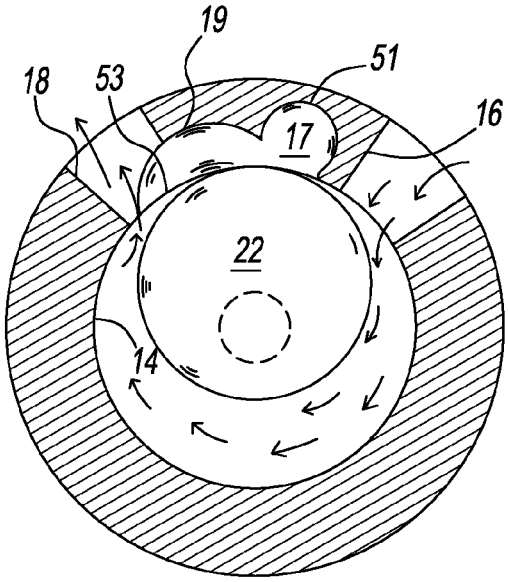

Referring now to FIGS. 2A-2D, a description of operation will be given. FIGS. 2A-2D represents progressively different degrees of rotor position over about 360° of travel in a clockwise direction. FIG. 2A corresponds in rotor position to FIG. 1.

In FIG. 2A, the rotor is nearing closing the swinging abutment 17 with outlet pressure exerting force against the flapper 50 of the abutment 17 providing sealing against the rotor 22. The flapper is designed dynamically to allow the force of the outlet stream to exert pressure against it while not severely restricting outlet flow.

In FIG. 2B, the rotor 22 has closed the swinging abutment 17 into the swinging abutment pocket 19. Note the base 53 of the swinging abutment 17 conforms to the radius of the inner wall 14. Also note that when the swinging abutment 17 is in this position, it does not entirely seal the outlet port 18 to prevent excessive pressure and wear on the abutment and abutment pocket. At this specific rotor position, as the rotor travels, frictional forces upon the swinging abutment, specifically the swinging abutment held in place in the pivoting joint 51 result a kicking out action of the swinging abutment urging and assisting continuing rotor contact. This action is also assisted by the pulsation typical of rotary pumps and outlet back pressure exerted upon the swinging abutment, all together that have the effect of maintaining sealing contact with the rotor body.

Figure 2C:
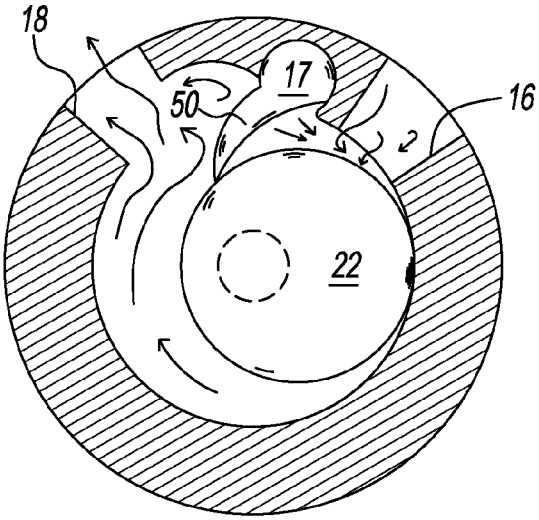

In FIG. 2C, additional forces assist in maintaining the contact of sealing the abutment 17 against the rotor 22. Inlet forces or suction created by the rotor 22 travel create a pulling or negative pressure upon the swinging abutment flapper 50 assisting the sealing against the rotor body.

Figure 2D:
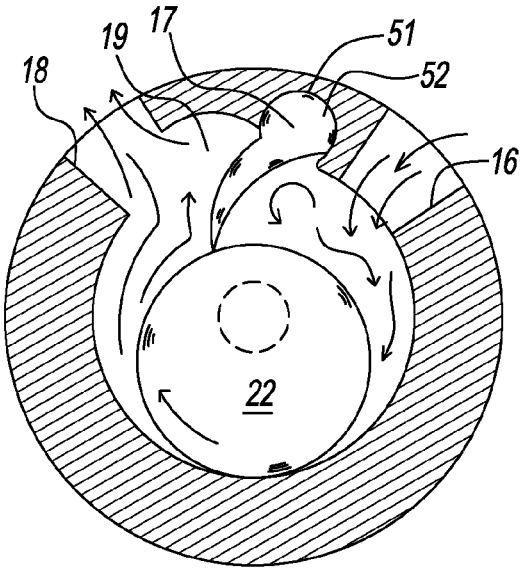

In FIG. 2D, both positive and negative pressures from fluid intake and outlet through inlet and exhaust ports, 16 and 18 are exerted upon the swinging abutment showing the forces to maintain a seal upon the rotor. Swinging abutment rotor contact is assisted by outlet back pressure pulsation and suction forces from inlet pressure. During all positions of the rotor 22 and swinging abutment 17, its pivoting joint 52 is pressed against the pivoting joint portion 51 of the swinging abutment pocket 19 providing a partition of the inlet and outlet streams when the swinging abutment is sealed against the rotor.

Figure 3:
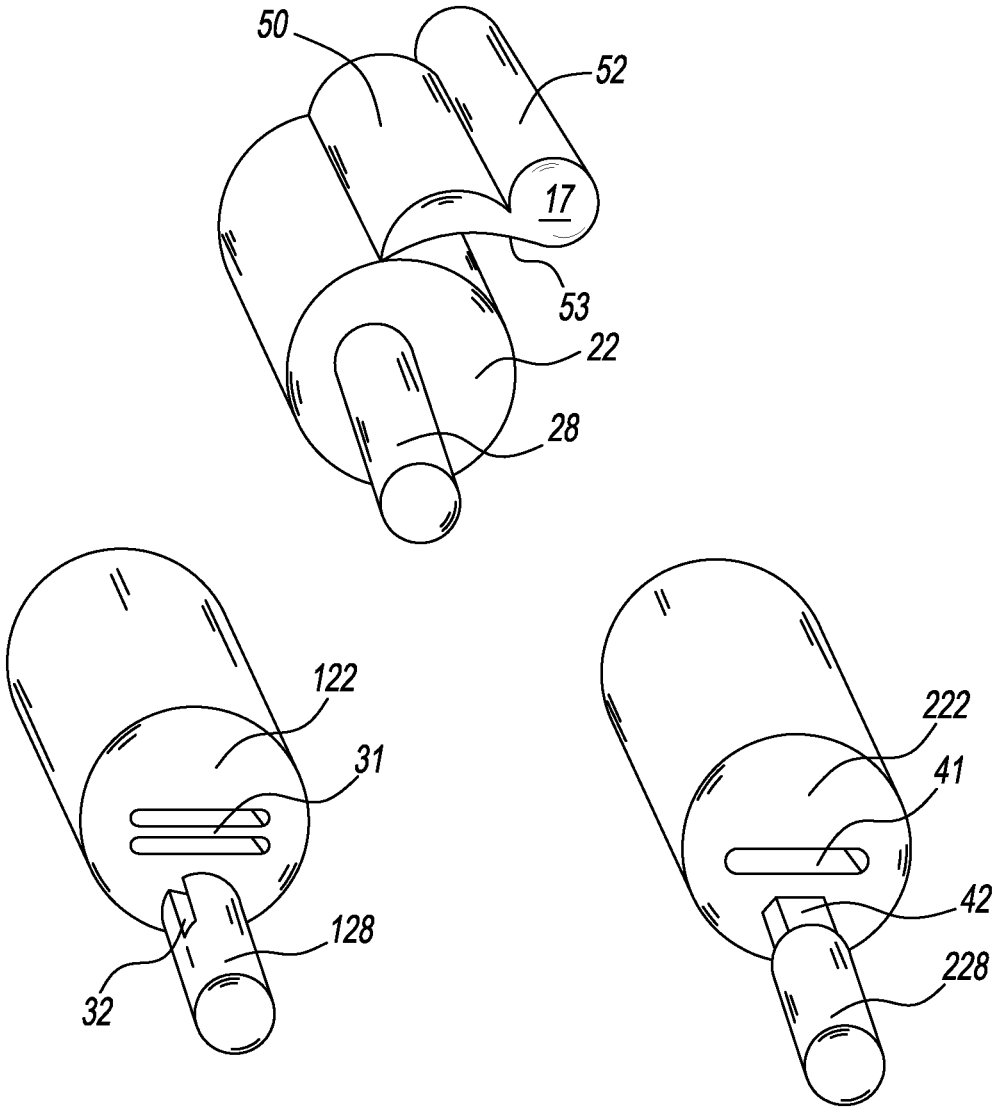
FIG. 3 is a perspective view of the swinging abutment, rotor, and drive for the pump. Also shown are an alternative rotor bodies and drive members.

FIG. 3 is a perspective view of the swinging abutment 17, rotor 22, and drive post 28 with the rotor body being comprised from a single piece of material or drive post 28 being press fit, molded, cast, or welded into body of rotor 22. Referring now to the swinging abutment 17, shown are its flapper 50, pivoting joint 52, and the base 53 that makes contact with the rotor 22. The base 53 is shaped to conform to the inner wall of the chamber. Also shown is an alternative rotor body 122 with a tongue structure 31 and the drive post 128 with a slot feature 32. Another alternative rotor body is shown with rotor 222 with a slot feature 41 with a drive post 228 having a tongue structure 42. Both rotor and drive alternatives provide the rotor body with sliding engagement to use centrifugal force to maintain contact with the inner wall and/or compensate for rotor segment contact wear upon the inner wall of the pump stator.

Figure 4:
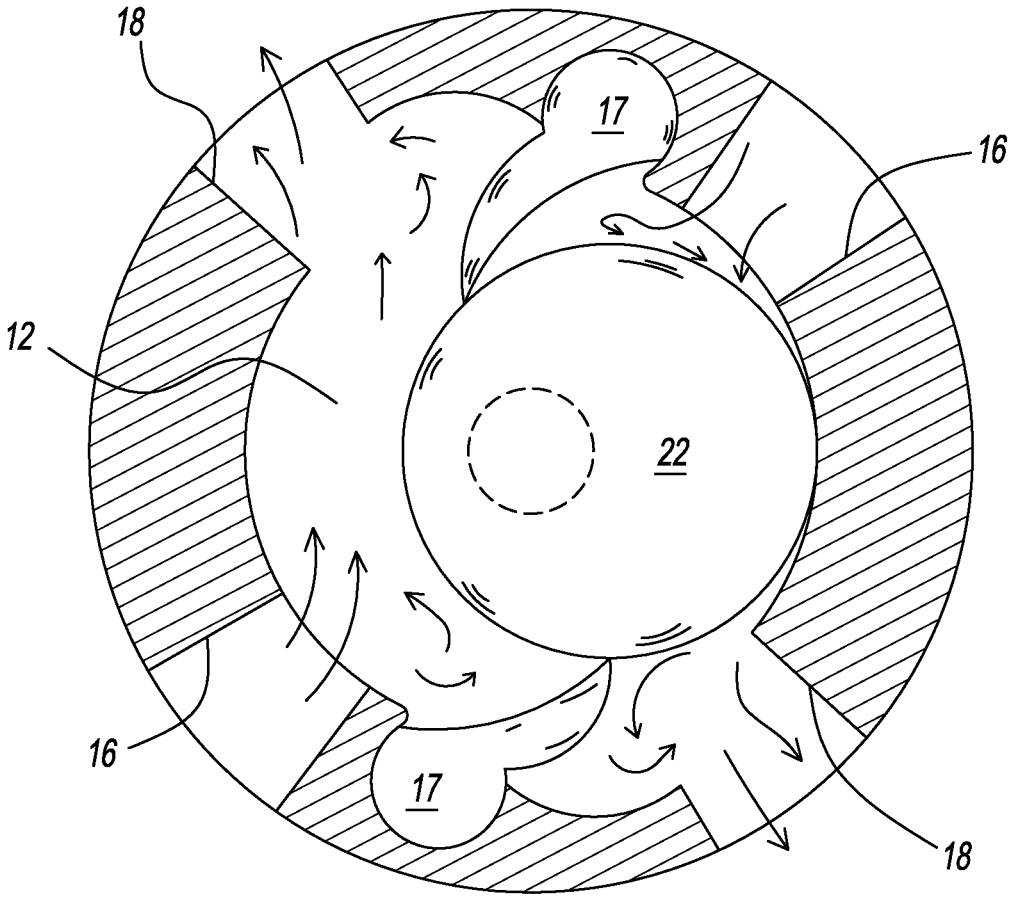
FIG. 4 is a plan view of an alternative pump having dual swinging abutments creating an additional pumping chamber.

FIG. 4 illustrates a stator 12 with dual abutments 17 and additional abutment pockets, inlet and exhaust ports, 16 and 18, to create dual pumping chambers within a single stator. Adding additional abutments and accompanying ports create multiple chambers within a single stator for applications requiring multiple feed and discharges from a single pump head. In the dual abutment pump configuration, two discharges occur with every 360° of rotor movement. The multiple abutment pump configuration allows for varied applications such as mixing and multi-stage pumping.

It will finally be understood that the disclosed embodiments represent presently preferred forms of the invention, but are intended to be explanatory rather than limiting of the invention. Reasonable variation and modification of the invention as disclosed in the foregoing disclosure and drawings are possible without departing from the scope of invention. The scope of the invention is defined by the following claims.

What is claimed:

1. A rotary pump comprising:

a stator housing having inner wall with an intake port and exhaust port being formed in the inner wall at spaced-apart locations, a rotor eccentrically mounted on axial drive post within the stator housing in contact with the inner wall, a swinging abutment pocket formed in the inner wall located between the exhaust and inlet port locations as the rotor rotating clockwise, and a swinging abutment is affixed in the swinging abutment pocket and wherein the swinging abutment does not completely seal the outlet port.

2. A rotary pump comprising:

a stator housing having an inner wall with at least two of intake ports and at least two of exhaust ports being formed in the inner wall at spaced-apart locations, a rotor eccentrically mounted on axial drive post within the stator housing in contact with the inner wall, at least two of swinging abutment pockets formed in the inner wall located between the exhaust and inlet port locations as rotor rotating clockwise, and at least two of swinging abutments, wherein each of the at least two of swinging abutments is affixed on each of the at least two of swinging abutment pockets, respectively, wherein the each of at least two of swinging abutments does not completely seal each of the at least two of outlet ports.

* * * * *